United States Patent [19]

Saunders

[11] 4,195,397

[45] Apr. 1, 1980

[54] COMPOUND BOW STRINGER

[75] Inventor: Charles A. Saunders, Columbus, Nebr.

[73] Assignee: Saunders Archery Company, Columbus, Nebr.

[21] Appl. No.: 919,845

[22] Filed: Jun. 28, 1978

[51] Int. Cl.[2] ..... B23P 19/02

[52] U.S. Cl. ..... 29/235; 124/23 R

[58] Field of Search ..... 124/23 R, 24 R, 24 A, 124/88, 90, 30; 29/235, DIG. 3, DIG. 42, 427, 452; 24/115 R, 115 F, 115 H, 115 J, 115 K

[56] References Cited

U.S. PATENT DOCUMENTS 656,431 8/1900 Stewart ..... 24/129 A 4,074,409 2/1978 Smith ..... 124/23 R

*Primary Examiner*—William R. Browne

*Attorney, Agent, or Firm*—Michael G. Berkman

[57] ABSTRACT

A bow stringer for compound archery bows, including an inextensible cord for attachment to upper and lower string segments supported by respective upper and lower limbs of the bow. An elastic slack take-up device is attached to vertically separated loci on the cord, to reduce slack and to prevent inadvertent detachment from the upper and lower string segments. Manual force is applied to the cord through a U-shaped handle having a grip portion spaced apart from a bar attached to the cord.

4 Claims, 3 Drawing Figures

FIG-1
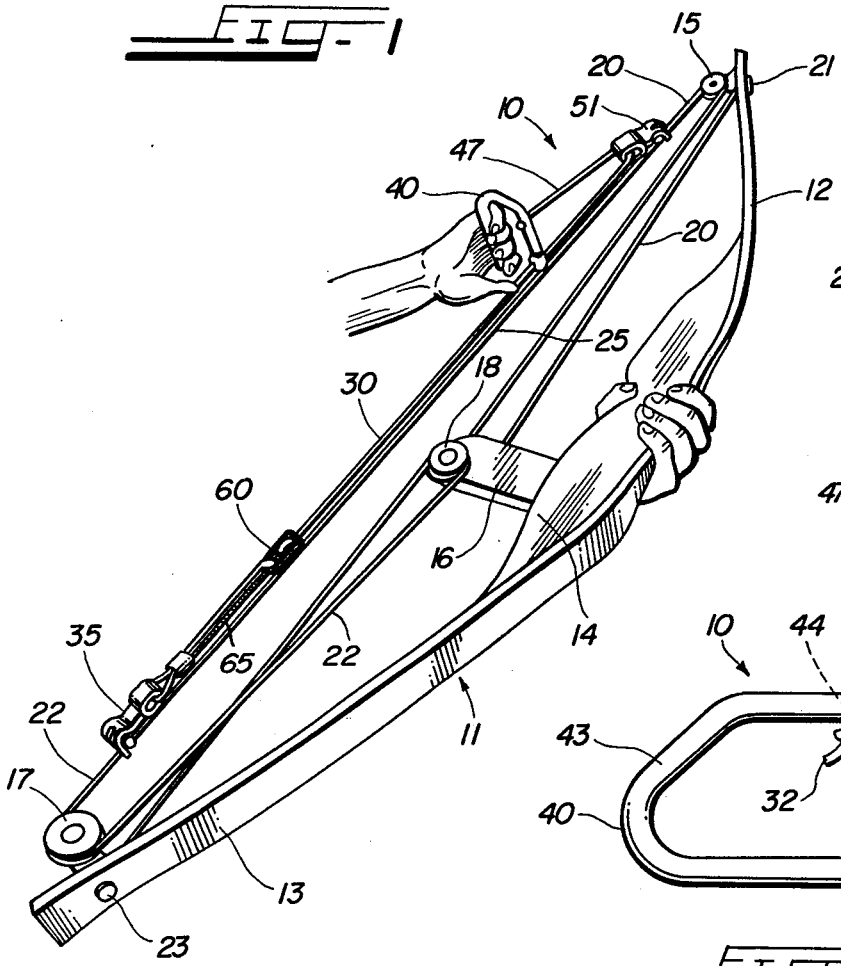
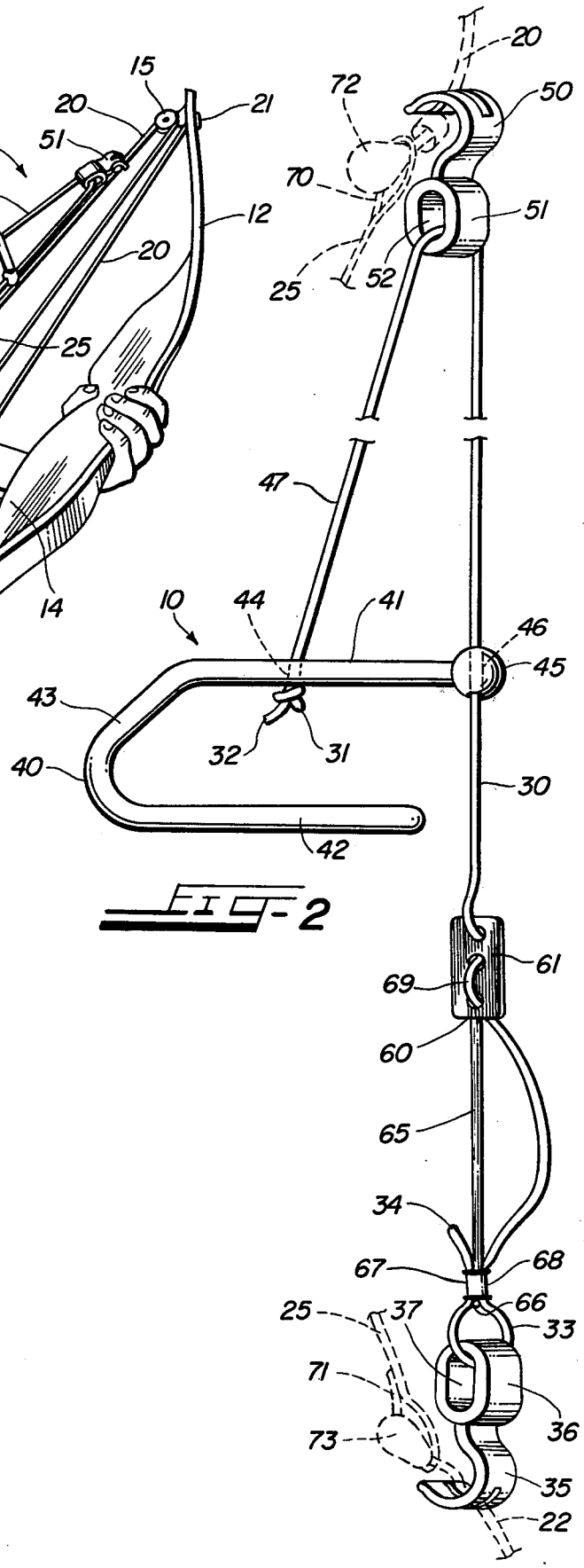
FIG-2
FIG-3
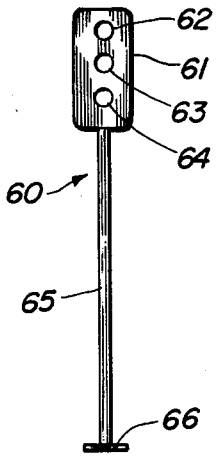

COMPOUND BOW STRINGER

BACKGROUND OF THE INVENTION

Various devices for assisting archers in the restringing of conventional bows are known in the prior art. Such devices are shown in Chelf U.S. Pat. No. 3,055,655; Browning U.S. Pat. No. 3,207,145; and Pearson U.S. Pat. No. 3,253,587. These prior art bow stringers are useful for the replacement of strings in conventional bows, but they are not specifically designed for restringing compound bows.

With increasing sales and usage of compound bows in recent years compared with conventional archery bows, a need has arisen for a simple and inexpensive device to assist in manual replacement of broken or damaged bow strings in compound bows. Compound bow stringers differ from bow stringers for conventional bows in that attachment is made to string segments supported by opposed upper and lower limbs of the bow rather than directly to the limbs. Attachment to the string segments is preferred over attachment to the limbs of compound bows in order to prevent loss of adjustment.

It is a principal object of the present invention to provide a compound bow stringer having an elastic take-up means joining two vertically spaced loci on a cord tensioning the bow.

It is a related object of the invention to provide for manual adjustment of slack in the cord of the bow stringer.

Another object of the invention is to provide the compound bow stringer of the invention with a handle having a grip portion which does not pinch the fingers of a user.

Additional objects and advantages of the present invention will become apparent to persons skilled in the art from the following specification, taken in conjunction with the drawings.

BRIEF DESCRIPTION OF THE DRAWINGS

FIG. 1 is a perspective view of a compound bow stringer of the invention, attached to a compound bow;

FIG. 2 is a front elevational view of the compound bow stringer of FIG. 1; and

FIG. 3 is a front elevational view of the slack take-up means of the compound bow stringer of FIGS. 1–2.

DESCRIPTION OF A PREFERRED EMBODIMENT

The compound bow stringer 10 of the invention is used in conjunction with a compound bow 11, shown in FIG. 1. The compound bow 11 includes a resilient upper limb 12 and a resilient lower limb 13 joined by a handle 14. An eccentric upper pulley 15 is fastened to the upper limb 12 and a first center pulley (not shown) is fastened to a center support 16 extending rearwardly of the handle 14. An eccentric lower pulley 17 is fastened to the lower limb 13 and a second center pulley 18 is fastened to the center support 16 on a side opposed to the first center pulley.

The compound bow 11 supports an upper string segment 20 wound around the upper pulley 15 and first center pulley before terminating at a fastener 21 on the upper limb 12. Similarly, a lower string segment 22 winds around the lower pulley 17 and second center pulley 18, then terminates at a fastener 23 on the lower limb 13. A bow string 25 extends between the upper and lower string segments 20, 22.

Referring now to FIG. 2, the bow stringer 10 comprises a synthetic cord 30 extending between a knot 31, adjacent a first end 32, and a fixed loop 33 adjacent a second end 34 spaced from the first end by approximately 46 inches of cord. The preferred cord shown has a diameter of about ⅛ inch and is manufactured from Dacron brand polyester fiber. The cord 30 is relatively inextensible, stretching less than about ¼ inch when a tension of 40 pounds is applied from both ends 32, 34.

The second end 34 is attached to the lower string segment 22 by a metal hook 35 having a plastic grommet 36 affixed to its upper end. The fixed loop 33 passes through an opening 37 in this plastic grommet 36.

A metal, generally U-shaped handle 40 is attached to the first end 32 of the cord 30. The handle 40 includes a bar or bar portion 41, a grip or grip portion 42 parallel to and spaced apart from the bar 41, and a bight or bight portion 43 joining one end of the bar 41 and grip 42.

The bar 41 defines a transverse through opening 44 through which the first end 32 of the cord 30 is passed. A knot 31 in the cord 30 attaches the cord to the bar 41.

A nylon bead 45 is affixed to a free end of the bar 41. The bead 45 defines a through opening 46 slidably embracing a portion of the cord 30 intermediate the first end 32 and second end 34. A looped segment 47 of the cord 30 extends between the bead 45 and the first end 32. Size of the looped segment 47 is variable, depending upon length of cord 30 on either side of the bead 45.

A metal hook 50 attaches the looped segment 47 to the upper string segment 29 of the bow 11. A plastic grommet 51 is affixed to a lower portion of the hook 50. The looped segment 37 slides through a through opening 52 in the grommet 51.

The bow stringer 10 of the invention includes a slack remover or take-up means 60, shown in FIGS. 1–3. The slack remover 60 includes a harness 61 defining three through openings 62, 63, 64; a longitudinally stretchable elastic tube 65 affixed to the harness 61; and a small boss 66 at a lowermost end of the tube 65. A metal crimping device 67 embraces a first locus 68 on the cord 30 and a lower extremity of the tube 65 just above the boss 66.

The harness 61 slidably embraces a second locus 69 on the cord 30 separated from the first locus 68 by a given vertical distance. The harness 61 is slidable upwardly and downwardly along the cord 30 for selective variation of slack therein. In FIGS. 1 and 2 the harness 61 is adjusted to provide the slack remover 60 with an effective length shorter than the above-mentioned given vertical distance.

For replacing a bow string, the two metal hooks 35, 50 are secured to respective lower and upper string segments 22, 20 as shown in FIG. 2. The handle 40 is pulled manually downwardly, as shown in FIG. 1. Such pull slackens the bow string 25 for easy removal from the string segments 22, 20. Because the user's fingers are applied to a grip portion 42 of the handle 40 rather than to the bar 41, the cord 30 is unable to pinch the fingers. This feature constitutes a distinct advantage over prior art bow stringers which are less comfortable to the hands.

When the metal hooks 35, 50 are first applied to the string segments 22, 20 it is possible for the hooks 35, 50 to become inadvertently disengaged because of insufficient tension in the cord 30. Such possibility of disengagement is minimized in the present invention by providing the bow stringer 10 with a slack remover or slack take-up means 60, shown in FIGS. 1–3. When the hooks 35, 50 are first applied to respective string segments 22, 20 the elastic tube 65 in the slack remover 60 automatically takes up slack in the cord 30, thereby minimizing the likelihood of inadvertent slippage and disengagement.

A new bow string 25 is secured to the string segments 20, 22 by attaching looped portions 70, 71 of the string 25 to beads 72, 73 affixed to the string segments 20, 22. This step is facilitated by pulling the handle 40 of the bow stringer 10 downwardly to shorten the length of cord 30 between the two metal hooks 35, 50 and to provide slack in the string 25. When there is sufficient slack in the string 25, the handle 40 is twisted toward the cord 30 to lock the grommet 45 in place. After a new string 25 has been installed, the handle 40 is twisted away from the cord 30 and the cord 30 is slackened, thereby tensioning the string 25.

The foregoing description of my invention has been made with respect to a preferred embodiment, and no unnecessary limitations should be inferred therefrom. Numerous changes and modifications may be made without departing from the spirit and scope of the invention as set forth in the following claims.

What is claimed is:

1. In a bow stringer for restringing a compound bow of the type including an inextensible cord, said cord including a first end, a second end opposed to said first end, and means for attaching the second end to a first string segment supported by one limb of a bow, a handle comprising a bar attached to the first end of the cord and slidably embracing a portion of said cord intermediate said first end and said second end, thereby forming a looped segment in a portion of the cord adjacent said first end thereof, means for attaching said looped segment to a second string segment supported by an opposing limb of a bow at a location on said cord intermediate said first end and the portion of the cord embraced by said bar, and an improvement comprising:

elastic slack take-up means attached to a first locus on said cord and to a second locus on said cord separated from said first locus by a pre-determined cord length, said slack take-up means being shorter than said pre-determined cord length when said cord is slack and substantially equal to said pre-determined cord length when said cord is taut for reducing slack in said cord upon initial engagement of said attachment means to said first and second string segments thereby preventing inadvertent detachment of said attachment means therefrom.

2. The bow stringer of claim 1, wherein said slack take-up means comprises an upper extremity and a lower extremity spaced downwardly of said upper extremity, and further comprising means affixing said lower extremity to said fixed first locus on the cord, and means attaching said upper extremity to said second locus manually adjustable upwardly and downwardly along said cord for selective manual adjustment of slack in said cord.

3. The bow stringer of claim 1, wherein said handle comprises a grip portion parallel to and spaced from said bar, and a bight portion joining said bar and said grip portion.

4. The bow stringer of claim 3, wherein said handle is generally U-shaped.

* * * * *